US008991668B2

(12) United States Patent
Pylypiak

(10) Patent No.: US 8,991,668 B2
(45) Date of Patent: Mar. 31, 2015

(54) BODY CONFORMABLE CONCEALED WEAPON HOLSTER

(76) Inventor: Andrew P. Pylypiak, Wadsworth, OH (US)

( * ) Notice: Subject to any disclaimer, the term of this patent is extended or adjusted under 35 U.S.C. 154(b) by 378 days.

(21) Appl. No.: 13/280,688

(22) Filed: Oct. 25, 2011

(65) Prior Publication Data

US 2013/0098956 A1 Apr. 25, 2013

(51) Int. Cl.
*F41C 33/00* (2006.01)
*F41C 33/04* (2006.01)
*F41C 33/02* (2006.01)

(52) U.S. Cl.
CPC ..... *F41C 33/048* (2013.01); *F41C 33/0209* (2013.01)
USPC ..... 224/192; 224/193; 224/587; 224/660

(58) Field of Classification Search
USPC ..... 224/219, 666, 255, 243, 244, 193, 149, 224/660; 42/70.11, 96
See application file for complete search history.

(56) References Cited

U.S. PATENT DOCUMENTS

| | | | | | |
|---|---|---|---|---|---|
| 1,166,781 | A | | 1/1916 | Parrish | |
| 1,768,177 | A | | 6/1930 | Wanee | |
| 2,758,762 | A | * | 8/1956 | Medley | 224/243 |
| 2,765,107 | A | | 10/1956 | Browning | |
| 2,884,172 | A | * | 4/1959 | Kubo | 224/149 |
| 3,315,855 | A | | 4/1967 | Boone | |
| 3,642,184 | A | | 2/1972 | Hendricks | |
| 3,796,358 | A | | 3/1974 | Grubb | |
| 4,412,397 | A | * | 11/1983 | Bayn | 42/70.11 |
| 5,167,355 | A | | 12/1992 | Hill | |
| 5,412,959 | A | * | 5/1995 | Bentley | 70/30 |
| 5,611,471 | A | | 3/1997 | French | |
| 5,749,507 | A | | 5/1998 | Wood | |
| 5,806,739 | A | | 9/1998 | Wood | |
| 6,019,404 | A | * | 2/2000 | Pasquale | 294/219 |
| 6,230,946 | B1 | * | 5/2001 | Vor Keller et al. | 224/244 |
| 6,247,623 | B1 | | 6/2001 | Walters | |
| 8,555,540 | B2 | * | 10/2013 | Woodford | 42/70.11 |

OTHER PUBLICATIONS

Vanguard Trigger Guard Holster, Raven Concealment Systems, www.ravenconcealmentsystems.com webpage, product added to catalog Oct. 2008, 1 page.
The Zacchaeus Concealment Holster, Dale Fricke website page www.dalefrickeholsters.com, date unknown but prior to filing date of this application, 2 pages.

* cited by examiner

*Primary Examiner* — Brian D Nash
*Assistant Examiner* — Corey Skurdal
(74) *Attorney, Agent, or Firm* — Hudak, Shunk & Farine Co. LPA

(57) ABSTRACT

A holster or firearm anchor-designed to house a weapon or firearm, preferably a handgun. In particular, the holster is adapted to be worn by a user in a concealed fashion under various outer garments, the holster comprising components that are capable of conforming to various body contours and additionally being able to substantially control the vertical and horizontal motion of the firearm.

18 Claims, 18 Drawing Sheets

BODY CONFORMABLE CONCEALED WEAPON HOLSTER

FIELD OF THE INVENTION

The present invention relates to a holster or firearm anchor designed to house a weapon or firearm, preferably a handgun. In particular, the holster is adapted to be worn by a user in a concealed fashion under various outer garments, the holster comprising components that are capable of conforming to various body contours and additionally being able to substantially control the vertical and horizontal motion of the firearm.

BACKGROUND OF THE INVENTION

Holsters or holders for various firearms, in particular handguns are known and are produced in many forms from numerous different materials. There are several separate and distinct classes of holsters including but not limited to professional duty weapons, tactical weapons and concealed carry weapons. The primary function of a holster is to secure a firearm in a specific location, such as on the body of a person, by controlling the movement of the weapon such as in a vertical and/or horizontal direction. In various embodiments, the holster can function as a safety device and include portions which prevent the trigger of the firearm from contacting foreign objects which could lead to an accidental discharge of the firearm.

Concealed carry weapon holsters make use of a specific location on the body to hide and secure a firearm, for example a torso, waist, or ankle. Concealed carry weapon holsters must be worn underneath clothing or completely encase a firearm in a disguised fashion in order to achieve concealment. Various materials such as, but not limited to, leather, fabric, metal, and polymers are used to form various components of the holsters, such as slots, straps, housings, paddles, or clips to tether the holster to the person.

Various holsters are known in the art.

U.S. Pat. No. 1,166,781 relates to pistol, or automatic magazine gun holsters, and its object is to provide a holster which will reportedly permit a gun therein from being accidentally removed, and which will reportedly properly and securely retain the gun in proper position for its removal when desired for use.

U.S. Pat. No. 1,768,177 relates to a holster, the general object of the invention being to so form the holster that the gun can be reportedly removed therewith the least possible effort, the releasing means being so formed that the thumb of the hand grasping the handle of the gun is used for actuating such means so that as the gun handle is grasped, the releasing means can be moved away from the body without requiring it to be withdrawn from the holster.

U.S. Pat. No. 2,765,107 relates to a holster for pistols.

U.S. Pat. No. 3,315,855 relates to gun holsters. The holster has a hook means including a bend adapted to be hooked over a waistband to be supported thereby. A portion of the hook extends inside the trousers. A stud is connected to and projects directly from the hook means remote from the bend inside the trousers so as to receive the discharge end of the hand barrel, thereby to support the barrel of the hand-gun inside the trousers with the grip resting atop the waistband where it may readily be grasped by the wearer. The barrel itself rests against the abdomen. The stud is pivotally connected to the hook means, whereby the angle of the stud relative thereto may adjustable be varied.

U.S. Pat. No. 3,642,184 relates to a light firearm mount fastened around a waistband or belt and includes an inclined pedestal having a J-shaped lip which is insertable into the gun's barrel for providing both a bottom support and vertical stabilization. Two clips extend laterally from the pedestal to provide a first lateral support for the barrel and a second lateral support for an intermediate portion of the firearm. A belt clamp having two laterally spaced clamp arms is fastened around the user's belt. The belt clamp can form integral part with the pedestal.

U.S. Pat. No. 3,796,358 relates to a gun holder bracket adapted to removably mount a gun having a first portion adapted for mounting on a supporting structure, a second portion extending at an angle from the first portion, and a pin extending from the second portion in the direction of the plane of the first portion. The gun holder bracket in operation is adapted to have a gun barrel placed therearound the pin.

U.S. Pat. No. 5,167,355 reportedly relates to a fast draw holster having an open front that supports a handgun with a bore penetrating pin correlated with the caliber and with opposed sides compressively engaging the barrel. A spacer positioned forwardly of the pin reportedly prevents intermittent and non-uniform pressure contact with the front lower edge of the holster upon withdrawal of the handgun. A ratchet mechanism attaching the holster to a belt supported fender reportedly permits the degree of vertical alignment of the holster to be adjusted commensurate with a shooter's preference.

U.S. Pat. No. 5,611,471 relates to a gun holster comprising a main frame, two flattened C-shaped pieces or the like for mounting the holster to an object, a trigger guard support arm or the like to prevent lateral movement, and a gun support such as a barrel support arm. Also, either a frame support arm or a cylinder locking arm, depending on the type of pistol to be holstered, are provided. The holster may also comprise a unitary piece.

U.S. Pat. No. 5,749,507 relates to a holder for a weapon to be concealed beneath a user's garment that includes an elongated support plate member with a base portion at one end, a central portion extending at an angle with respect to the base portion and an upper portion extending from the central portion at an angle with respect to the central portion and the upper portion being in substantial perpendicular relationship with respect to the base portion. A front guiding plate member is perpendicularly mounted to one of the lateral edges at the upper and central portions. A rear guiding plate perpendicularly is mounted to the other lateral edge on the central portion and cooperatively positioned to substantially coincide with the trigger area of said weapon. A clip assembly for removably attaching the holder to a user's garment and the clip assembly being securely mounted to said front guiding plate.

U.S. Pat. No. 5,806,739 relates to a holder for weapons that include a barrel with a through opening and a trigger guard. A main plate assembly has a perpendicularly extending fixed base portion at one end and a movable base portion slidably mounted thereon to accommodate barrels of different dimensions. A pin receivable within the through opening is rigidly and perpendicularly mounted on the movable base portion. A pivotally mounted trigger guide assembly partially houses the trigger guard and, with the pin, supports the weapon when the holder is mounted to a flat surface.

U.S. Pat. No. 6,247,623 relates to a device reportedly capable of securing a firearm, with an incorporated trigger guard designed specifically to prevent accidental discharge of the weapon. The device also has an incorporated belt clip allowing the device to be attached to a belt or a pair of pants worn by a user. The device also has an incorporated gun barrel holder, allowing an additional securing means for a weapon that is placed within the present invention. A cloth cover on the gun barrel holder reportedly insures that the barrel of any weapon placed into the present invention will remain clean. The device also includes a rear mounted strap reportedly allowing any weapon placed within the device to be securely positioned in a non-flexible position.

Some common problems associated with concealed carry weapon holsters include one or more of printing, bulging, dress code application, accessibility, comfort, brand recognition and affordability.

Printing occurs when the basic size, shape and outline of a weapon becomes visible through the fabric of clothing used to conceal the weapon. When printing occurs, it can reveal the basic type of firearm one is carrying, the location of the weapon, and the manner in which the weapon is positioned.

With respect to bulging, when a firearm is encased in a holster, the holster adds size, weight and girth to the outside dimensions of the weapon in many cases. Furthermore, many holster manufacturers intentionally add excess encasement materials to alter the shape and outline of the firearm in effort to combat printing. Although these techniques are routinely used to disguise a weapon, they increase mass and make the firearm more difficult to conceal. Some of these holsters can produce large and pronounced bulges when worn under clothing. Although these bulges may not fully resemble the shape or outline of a firearm, they certainly draw attention to the area where the weapon is secured. Large bulges that are located on specific areas of the torso, waist, and ankles are often indicative of a concealed carry weapon.

With respect to dress code application, most concealed carry weapon holsters require the use of thick, loose fitting clothing in order to solve the problems associated with printing and bulging. Clothing that is commonly used for concealment includes: jackets, sweatshirts, and un-tucked flannel or button-type shirts. In most cases, at least one layer of clothing must be un-tucked and remain outside of (over) the waistband to conceal the firearm. Lightweight clothing that is suitable for warm seasons or climates, as well as attire for some formal, business or social settings, often renders these holsters useless for concealment purposes. Although there are a few holsters that have attempted to allow the user to tuck a shirt into the waistband over the top of a firearm, many of them result in a bulging effect. In addition to this, the clips which anchor most of these holsters to the waistband remain exposed and readily identifiable to anyone that is familiar with these types of holsters.

Regarding accessibility, some concealed carry weapon holsters are designed to secure firearms in more obscure areas of the body such as the chest, upper back, below the armpit, and the ankle. Although some of these holsters provide excellent concealment capabilities, they may impede the rapid deployment of a firearm. When a firearm is secured on an obscure portion of the body it can require a considerable amount of time, effort, and range of motion to deploy the weapon.

Considering comfort, most concealed carry weapon holsters are or static in design. These holsters may be very comfortable in one position and very uncomfortable in another position (standing/sitting). Some common problems include pinching, prodding, and minor skin irritation. Other holsters must be worn over and around entire regions of the body such as the torso and belly. These systems often result in increased perspiration and can also lead to mild skin irritations.

Some concealed carry weapon holsters are manufactured to look like other items such as an over-sized cell phone case, a fanny pack, or a Walkman® radio. Many consider this to be a fad market and as such there are a very limited number of products to choose from. These products are advertised as holsters and therefore it should be presumed that they will be recognized as such.

With respect to affordability, most concealed carry weapon holsters are firearm specific meaning that they will only fit one particular make and model of weapon. Therefore, if one wants to carry different firearms, he or she will be required to purchase additional holsters. In addition to this, there are certain holster shirts, underwear, and bellybands that are essentially articles of clothing with a sewn in holster. If this type of system is utilized you will need to purchase several holsters.

SUMMARY OF THE INVENTION

In view of the above, it would be desirable to provide a holster that provides for effective concealment and deployment of a firearm and additionally is of relatively simple construction, easily accessible, versatile, undetectable and comfortable.

It is thus an object of the present invention to provide a holster that is light in weight, streamlined and uncomplicated, thereby adding relatively little size, weight and girth to a firearm as necessary to secure the weapon on a person. Additionally, weapon retention/security is obtained through effective concealment of the firearm.

Still another object of the present invention is to provide a holster adapted to secure and position a firearm near the waistline of the holster wearer. Such positioning keeps the weapon in close physical proximity to the hands and facilitates rapid deployment of the firearm with minimal range of motion requirements.

Another object of the present invention is to provide a holster that allows for a smooth draw and little effort to be required to separate the weapon from the holster and its components thereby ensuring that the firearm is free of obstruction and combat ready as soon as it clears the waistline of the user.

A further object of the present invention is to provide a holster that is able to accommodate many different makes and models of firearms and allow the user to employ a preferred style of carry, for example one or more of strong-side/forward-cant, strong-side/straight-drop, and weak-side/cross-draw.

Still another object of the present invention is to provide a holster that is capable of concealing a firearm underneath temperature appropriate clothing and additionally allows the user to conform to dress codes and standards which are applicable for most public, social and professional settings.

An additional object of the present invention is to provide a holster that allows a user to wear a firearm underneath clothing while concealing the shape; size and location of the weapon.

A further object of the present invention is to provide a holster that substantially has no exposed parts that would indicate its presence or the presence of a firearm.

In an additionally embodiment, it is an object to provide a holster structure to allow the user to remain comfortable during periods of extended wear and varying temperature conditions. The holster should also provide freedom of movement as well as a wide range of motions without prodding, pinching or binding.

In one aspect, a holster for a firearm is disclosed, comprising a flexible anchor line having a first end portion adapted to be connected to an article of clothing of a user and a second end portion; an anchor system pivotally and operatively connected to the second end portion of the anchor line, the anchor system having a barrel support extending from a base of the anchor system and adapted to fit inside a portion of a bore of a barrel of the firearm, wherein the pivotal connection allows the barrel support to be moved in each of an X direction, a Y direction and a Z direction of a three-dimensional (X, Y, Z) Cartesian coordinate system in relation to the anchor line, with the Z direction being a vertical axis.

Another aspect of the invention is a holster for a firearm, comprising a contour conformable strap having a length; and an anchor system operatively connected to the strap such that a barrel support of the anchor can be positioned at any angle with respect to the strap, the barrel support having a segment adapted to be inserted into a bore of a barrel of the firearm.

An additional aspect of the invention is a holster for a firearm, comprising a contour conformable strap having a length; an anchor system operatively connected to the strap such that a barrel support of the anchor can be positioned at an angle with respect to the strap, the barrel support having a segment adapted to be inserted into a bore of a barrel of the firearm; and a trigger shroud comprising a piece of material having an aperture through which one or more of a portion of the strap and anchor system extend.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

The holster of the present invention includes an anchor system connected to a strap, preferably an anchor line adapted to be connected to a user, more particularly to an article of clothing of the user such as a belt, a pair of pants, or shorts, wherein the article of clothing includes a secure point of attachment such as a belt, button hole, or an auxiliary gear loop. In some instances, a belt loop or button will suffice provided that the stitching, material, and construction is adequate to support the weight of a firearm. One portion such as a first end portion of the strap is removably connectable to the article of clothing. A barrel support of the anchor system is inserted into a bore of a barrel of the firearm and then the firearm is tucked into the user's waistband, barrel first, until the strap becomes taut with the weight of the firearm resting predominantly on the holster's anchor system. Due to the flexibility of the strap and operative connection to the anchor system the firearm is then positioned at a desired angle in relation to the user's waistband which operatively maintains an additional point of contact with the firearm. Owing to the flexibility of the strap and adjustable or articulatable? connection between the strap and anchor system, the holster is closely conformable to the contours of the user's body, preferably the lower torso or abdominal region.

In various preferred embodiments, the holster includes a shroud that includes a trigger guard formed from a piece of material that is operatively connected to one or more of the anchor system and strap. The shroud is designed to cover the trigger portion of the firearm and allow a user to tuck a shirt between the user's pants, shorts or belt and the shroud.

Figure 1:
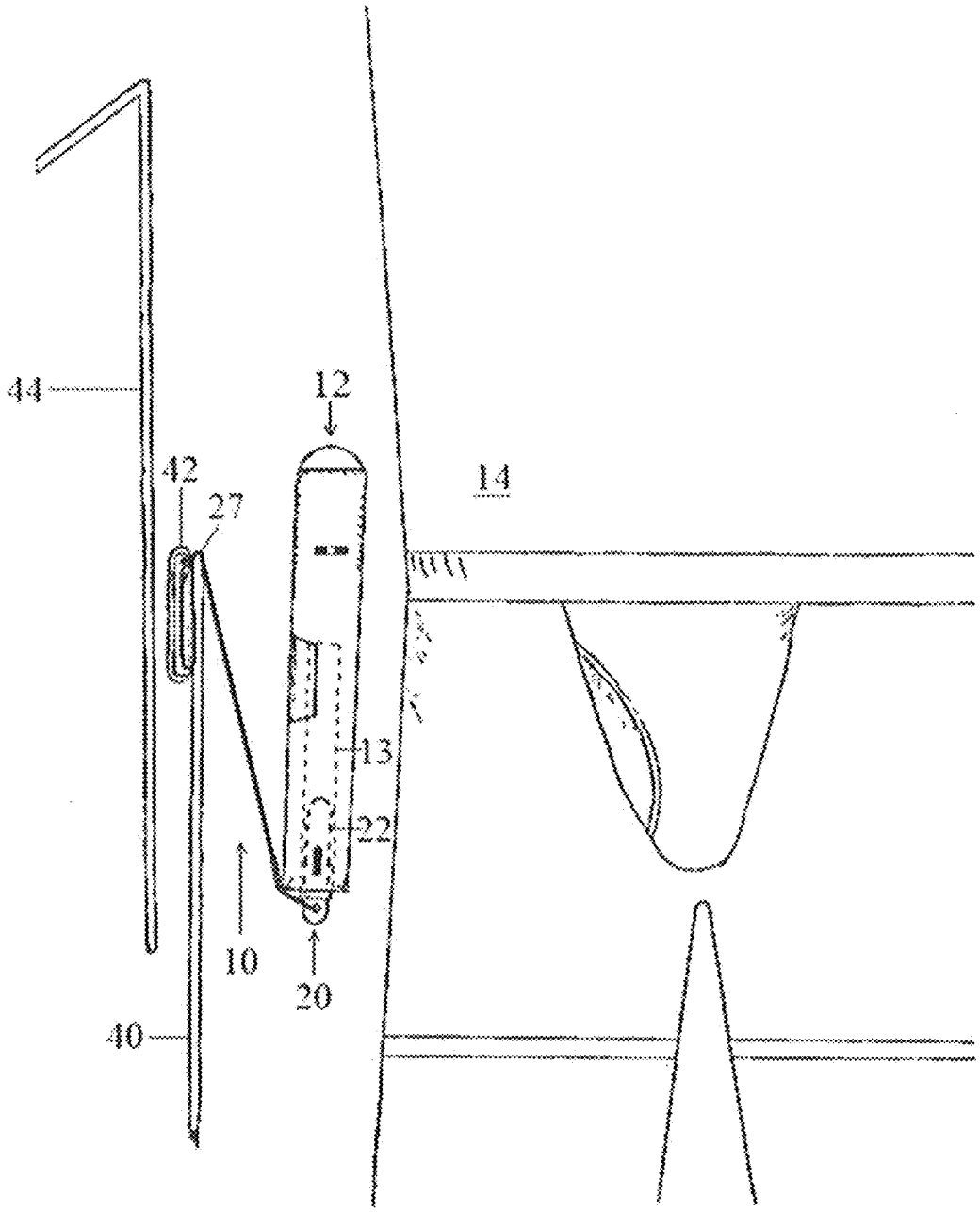
FIG. 1 is a partial cross-sectional side view of one embodiment of a holster of the present invention particularly illustrating a firearm connected to an anchor system of the holster and illustrated in relation to a user
Figure 8:
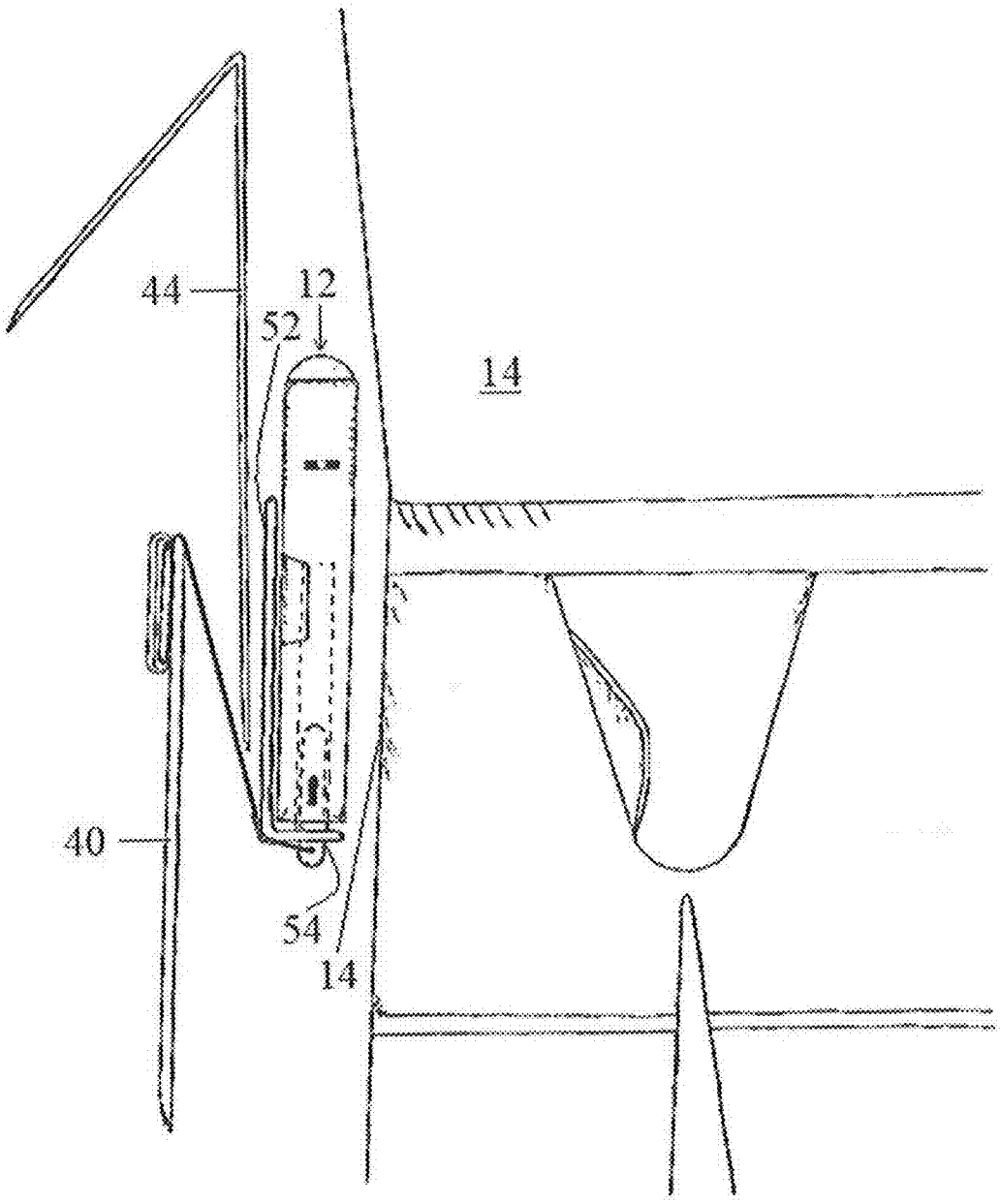
FIG. 8 is a partial cross-sectional side view of a further embodiment of the holster of the present invention illustrated in FIG. 4 operatively connected to a connection point on a user.

Referring now to the drawings, wherein like or similar parts are referred to utilizing the same reference numbers throughout the several views, FIG. 1 illustrates one embodiment of a holster 10 including an anchor system 20 having a barrel support 22, the anchor system 20 operatively connected to a strap 26. In additional embodiments such as illustrated in FIG. 8, the holster 10 in addition to including an anchor system 20 and a strap 26 also includes a trigger shroud 50 having a trigger guard section 52.

Figure 12A:
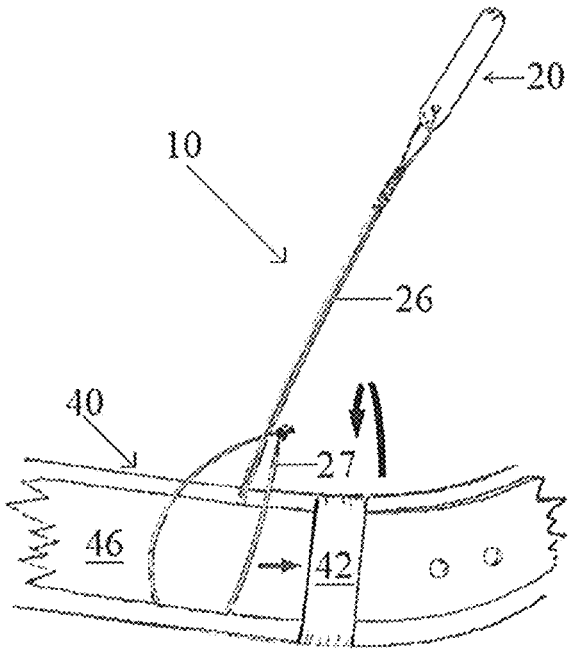
FIG. 12*a* illustrates one embodiment of a holster being secured to a belt through the use of a securing loop.
Figure 12B:
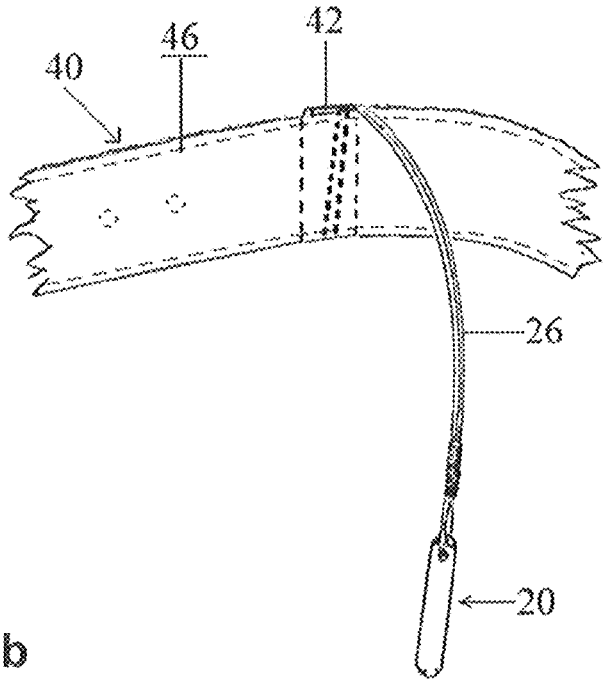
FIG. 12*b* illustrates the securing loop being tightened and concealed underneath of and behind the belt loop. The strap is draped over the top of and into a waistband.

A first end portion 27 of the strap 26 is shown removably and operatively connected to an article of the holster user's clothing in FIG. 1, in this particular embodiment a belt loop 42 of a pair of bottoms 40 such as pants, shorts or the like. The holster 10 can be connected to any suitable or desired portion of the user's clothing. For example, as illustrated in FIG. 12, the preferred method of securing the holster 10 to the user's clothing is shown. A user's bottoms 40 are illustrated including a belt loop 42 with a portion of a belt 46 extending therethrough. The first end portion 27 of strap 26 is extended around belt 46 and the anchor system 20 is extended through the loop. In this manner, the holster 10 is operatively connected to the belt 46.

Figure 13:
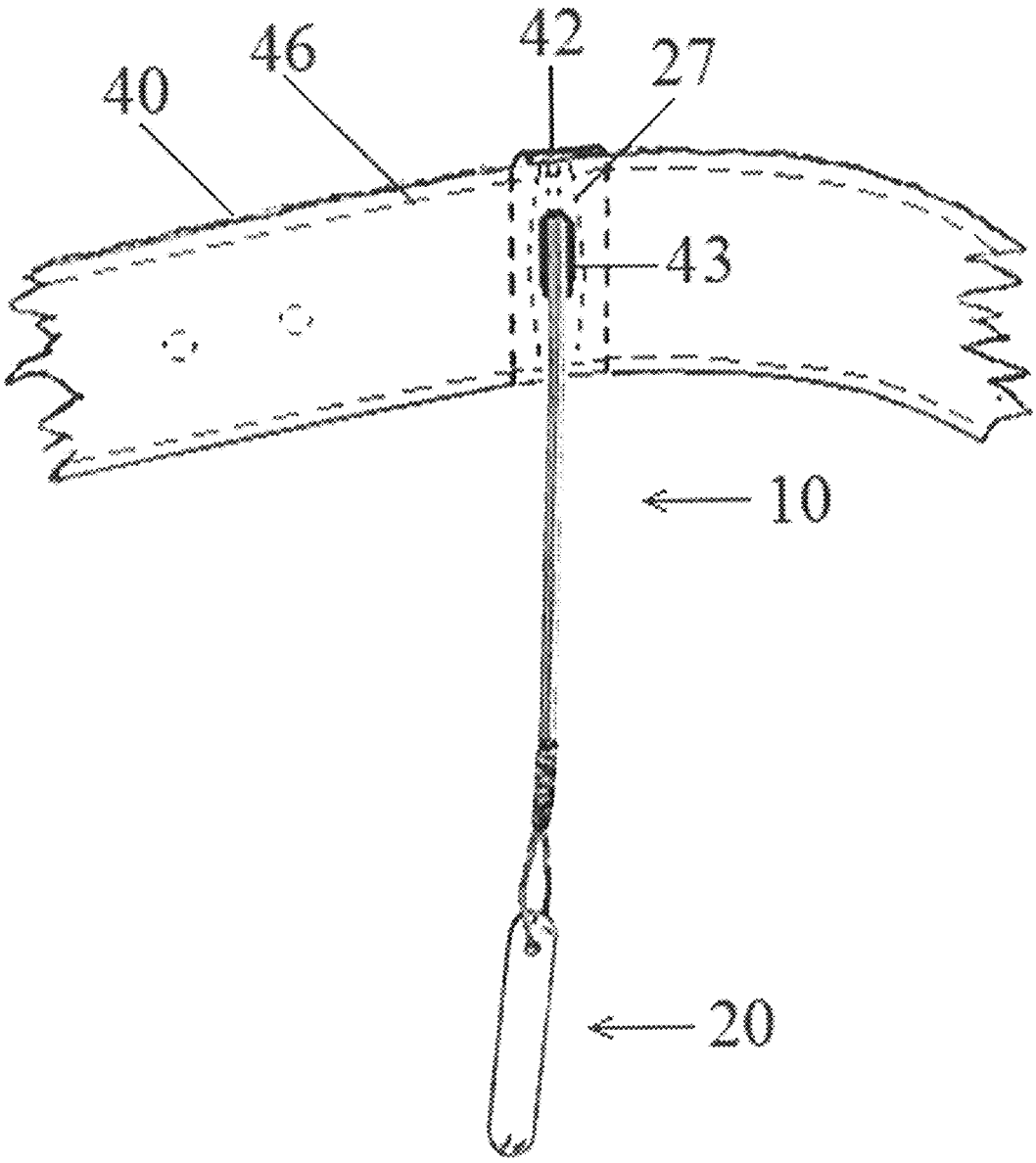
FIG. 13 illustrates one embodiment of a holster secured to a belt through an aperture in an article of clothing wherein the aperture allows the strap to be passed through the inside of the article behind a belt loop which eliminates the need to drape the strap over the top of the waistband and ensures full concealment.

In a further embodiment, as illustrated in FIG. 13 the anchor system and a portion of the strap 26 is extended through an aperture 43 in bottoms 40 behind belt loop 42 to add greater concealment.

As illustrated in FIG. 1, firearm 12 is shown with its barrel 13 engaged with the barrel support 22. A user's top 44 is shown hanging loosely outside of the bottoms 40. As illustrated in FIG. 8 in a further embodiment an article of clothing such as a top 44 for example, a shirt is shown tucked between a portion of the shroud 50 and the user's bottoms 40. The outline of a user 14 is also illustrated in FIGS. 1 and 8 to show relative positioning of the holster 10 and firearm 12 in relation to the user 14.

Figure 2:
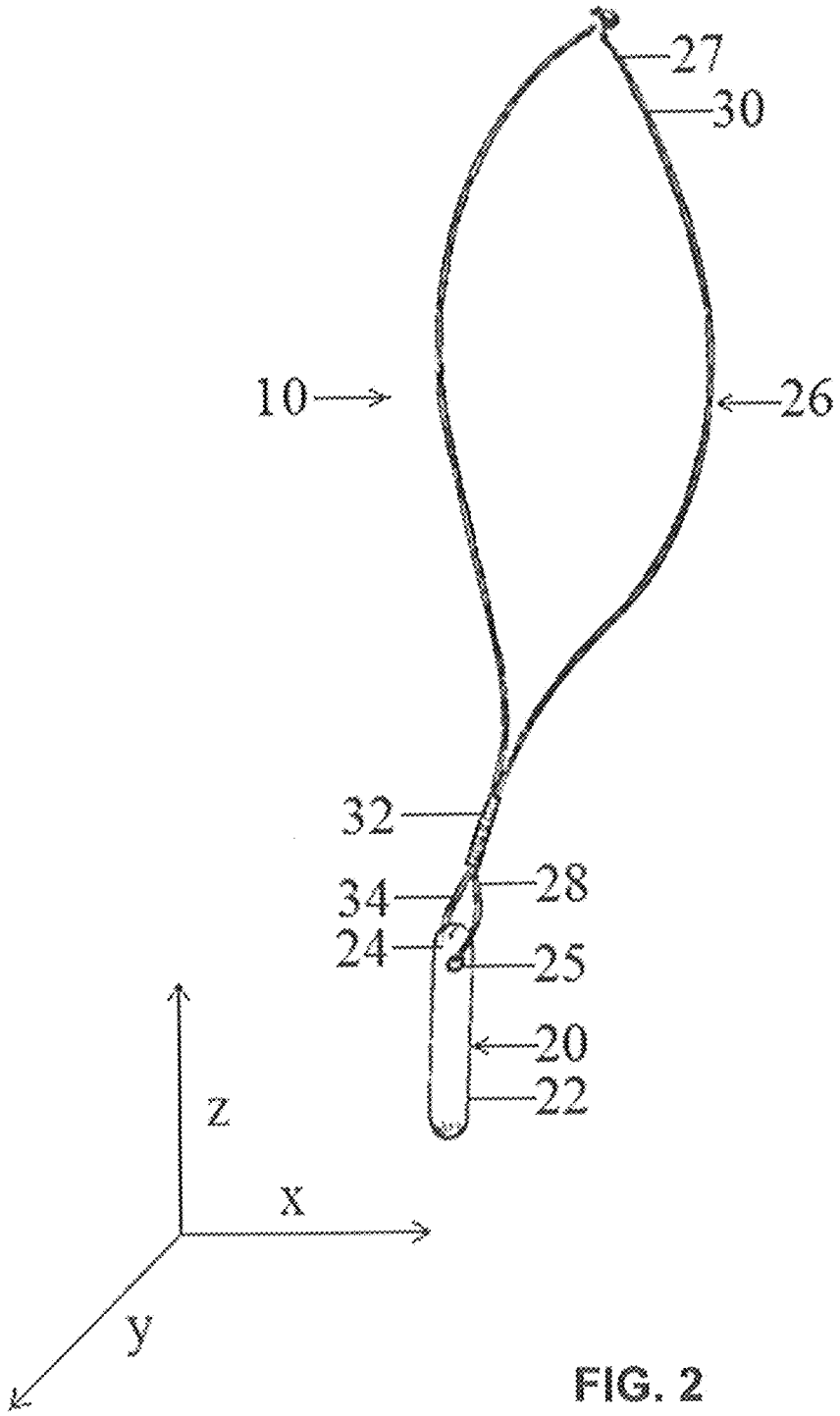
FIG. 2 is a front view of one embodiment of an anchor system of the holster of the present invention.

FIG. 2 illustrates a further embodiment of a holster 10 of the present invention which includes an anchor system 20 and a strap 26.

The strap 26 is formed of a relatively lightweight, flexible material. The strap can be formed from various materials. In a preferred embodiment, the strap is a cord or line. The strap in the form of a cord or line can be formed from a natural or synthetic material, for example a polymer, or a combination thereof; and can be braided or non-braided or include braided and non-braided components. Examples of suitable materials include, but are not limited to, polymers for example polyolefins such as polyethylene and polypropylene; nylon; acrylic; polyester. Natural fibers include both animal and vegetable fibers and include but are not limited to alpaca, angora, llama, rabbit, silk, wool, bamboo, cotton, flax, hemp, jute, kenaf, sisal and wood. Leather can also be utilized. In a preferred embodiment, the strap comprises nylon or polyester sheathed polyethylene fibers, for example Dacron® sheathed Spectra® fibers available from Zpacks of Palm Bay, Fla. The preferred fibers have a relatively high tensile strength, and are resistant to abrasion, moisture, and stretching.

The strap 26 can assume many forms so long as it maintains the function of affixing the anchor system 20 to a user's article of clothing in a concealed fashion, preferably at a fixed length. In one embodiment as illustrated in FIG. 2, the strap 26 includes a loop 30 at first end portion 27. The strap 26 also includes an anchor loop 34 at a second end portion 28.

Figure 16A:
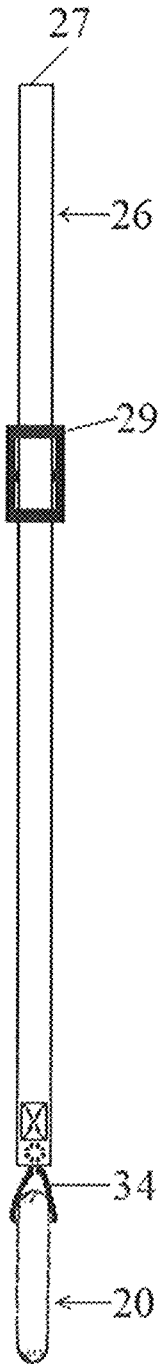
FIGS. 16*a* and *b* illustrate a front view and a side view, respectively, of a holster comprising a strap including a buckle to provide length adjustability, the strap including an anchor line sewn to a portion of the strap and connected to the anchor system.
Figure 16B:
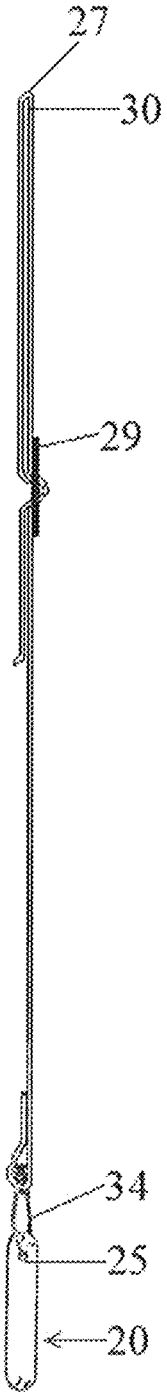

In additional embodiments, for example as shown in FIGS. 16*a* and 16*b*, the strap can include a buckle 29. The strap utilized in this embodiment has a greater width than the strap illustrated in FIG. 1. The anchor system end of the strap 26 is sewn onto itself and includes a loop with an aperture in a lower portion of the loop. A cord or line is passed through the aperture 25 in the anchor and the ends of cord are passed through the aperture in the bottom of the strap 26 and tied together to form a knot. The knot size prevents the cord from being removed from the strap. Buckle 29 allows the strap to be length adjustable.

The strap can be formed utilizing various methods. In one embodiment, for example as shown in FIG. 2, the strap comprises a cord of a suitable length, for example 24 inches in one embodiment, and is passed through the aperture in the anchor and the two loose ends are brought together to approximately divide the length of the cord in half. The loose ends are then tied together with an overhand knot and the positioning of the knot determines the length of the cord. To permanently secure a loop in place in the area of the anchor and keep the cord from separating, serving material 32 is applied, utilizing a whip finish. The serving material can be applied by wrapping a relatively strong thread or fibers around both cords a suitable length from the base of a loop, for example from about a ½ inch to about % inch from the base of the loop. The serving material is tightly wound and each individual wrap preferably touches or lies immediately next to the previous wrap. After a suitable length of serving is applied, for example about ⅜ inch, the loose end of the serving is wrapped in and around itself. Once a sufficient number of finishing wraps have been applied, the loose end is pulled back through the previous or existing wraps in the serving and the serving is effectively locked in place. The remaining or loose serving material is trimmed off and a small amount of heat is applied to the ends of the line to prevent them from fraying or slipping back through the wraps in the serving.

The anchor system 20 illustrated in FIG. 2 includes a base 24 and a barrel support 22 connected thereto. The base 24 includes an aperture 25 through which a portion of strap 26 extends, thereby affixing the anchor system to the strap 26.

Figure 18:
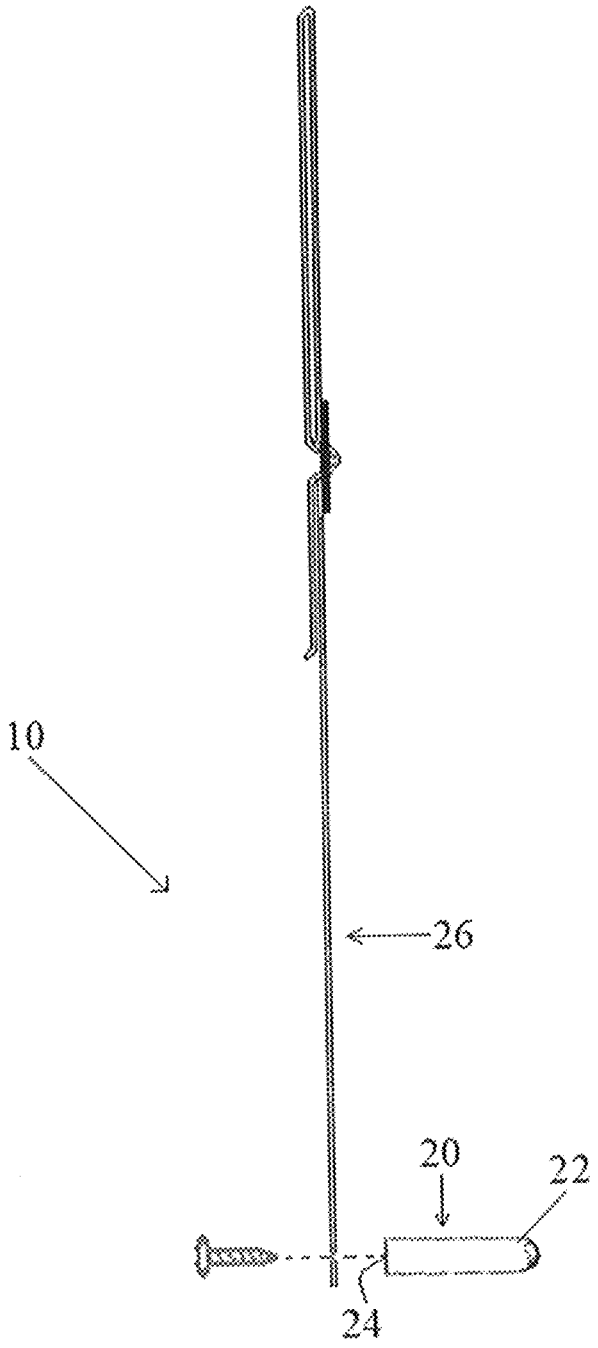
FIG. 18 is a side view illustrating an alternative means of connection between the anchor system and the strap.

FIG. 18 shows an alternative means of connecting the strap 26 of holster 10 to the anchor system 20. Therein it is illustrated that the barrel support 22 of anchor system 20 includes a base 24 having a relatively flat end. A portion of the strap is located between the base 24 and a fastener. As a strap 26 is flexible, the barrel support 22 can be manipulated as desired.

Figure 17:
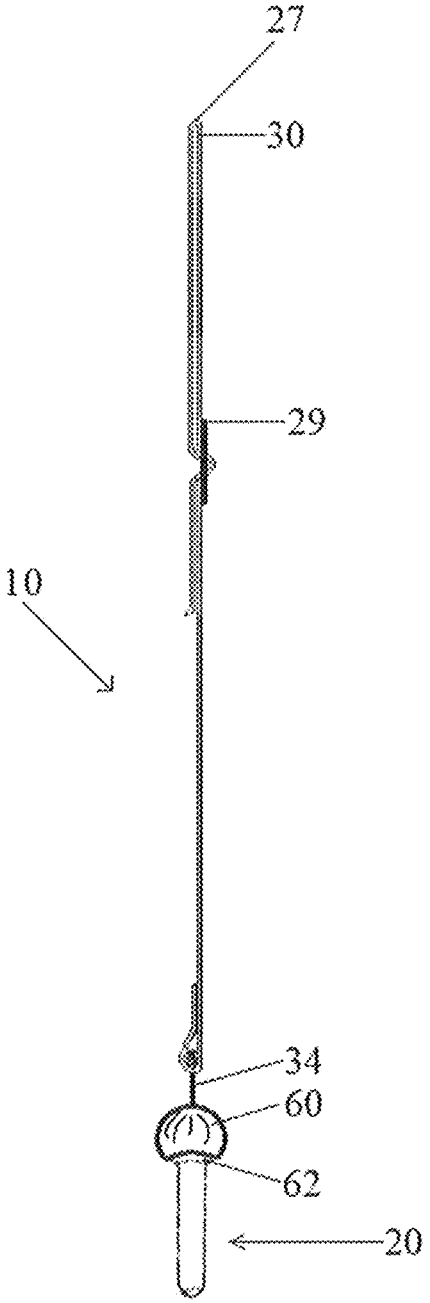
FIG. 17 illustrates a side view of a further embodiment of the holster of the present invention including an anchor system with a ball and socket configuration.

As further illustrated in FIG. 17, the holster 10 can include a ball and socket type connector, for example with the socket 60 being operatively connected to the strap 26, for example utilizing an anchor loop. In this embodiment, the anchor system includes a ball 62 that is rotatably connected in socket 60. The socket can possess an aperture that allows the strap 26 to be connected to it or a slot and rod type arrangement that allows the strap to be looped and connected around the rod. Such configurations allow the end of the strap to be inserted or otherwise passed through the socket where after it can be knotted, clipped, looped or otherwise attached to the socket.

In view of the flexible connection between the anchor system 20 and the strap 26, the anchor system 20 and more specifically the barrel support 22 can be moved in a plurality of different directions in relation to the strap 26 in order to accommodate a desired firearm. The barrel support 22, e.g. distal end thereof, and anchor system 20 can be positioned in a plurality of different locations with respect to X, Y and Z axes, each axis perpendicular to the others, with the strap portion extending through aperture 25, or otherwise being operatively connected to the anchor system, at a connection point considered a zero, i.e. (0,0,0) location of a three-dimensional Cartesian coordinate system in one embodiment, for example see FIG. 2 wherein the Z axis is vertical. Thus, the barrel support 22 can be moved in one or more, two or more or each of the X, Y and Z directions with respect to the zero position and thus strap 26 to allow positioning of the firearm at a desired location on the user's body. Stated in an additional manner, the distal end of barrel support 22 can be located at a positive Z position with respect to the strap, for example, as illustrated in FIGS. 1 and 8, when the anchor system 20 is in use with a firearm 12. When not in use, the distal end of the barrel support 22 can be located at a negative Z position with respect to the pivot point at aperture 25 or the zero position whereby the anchor system 20 is suspended by strap 26, see FIG. 2 for example.

Stated yet in another manner, the flexibility provided between the strap 26 and the anchor system 20 allows the anchor system to pivot, generally about a pivot point, for example at aperture 25, or at the ball 62 and socket 60 connection to accommodate firearms of different structure and dimension and further allow a user to position the firearm in a desired location. With respect to the pivot point, such as a point or area of connection between the strap 26 and the barrel support 22 of the anchor system 20, the flexibility of the holster allows the barrel support 22 to be positioned in a positive Z position and one or more of a positive X position, positive Y position; positive X position, negative Y position; negative X position, positive Y position and negative X position, negative Y position. The Z axis as illustrated in FIG. 2 is the vertical axis.

Figure 9:
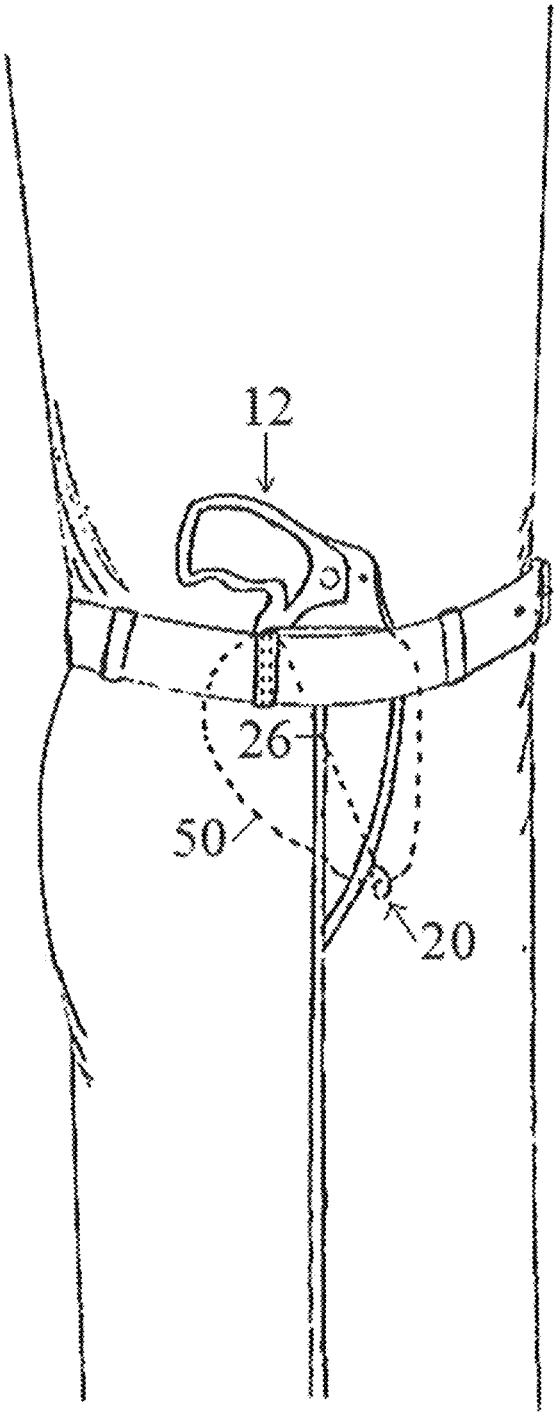
FIG. 9 illustrates a side view of a firearm in a holster positioned on a user wherein the firearm is positioned on the strong side, straight-drop.
Figure 10:
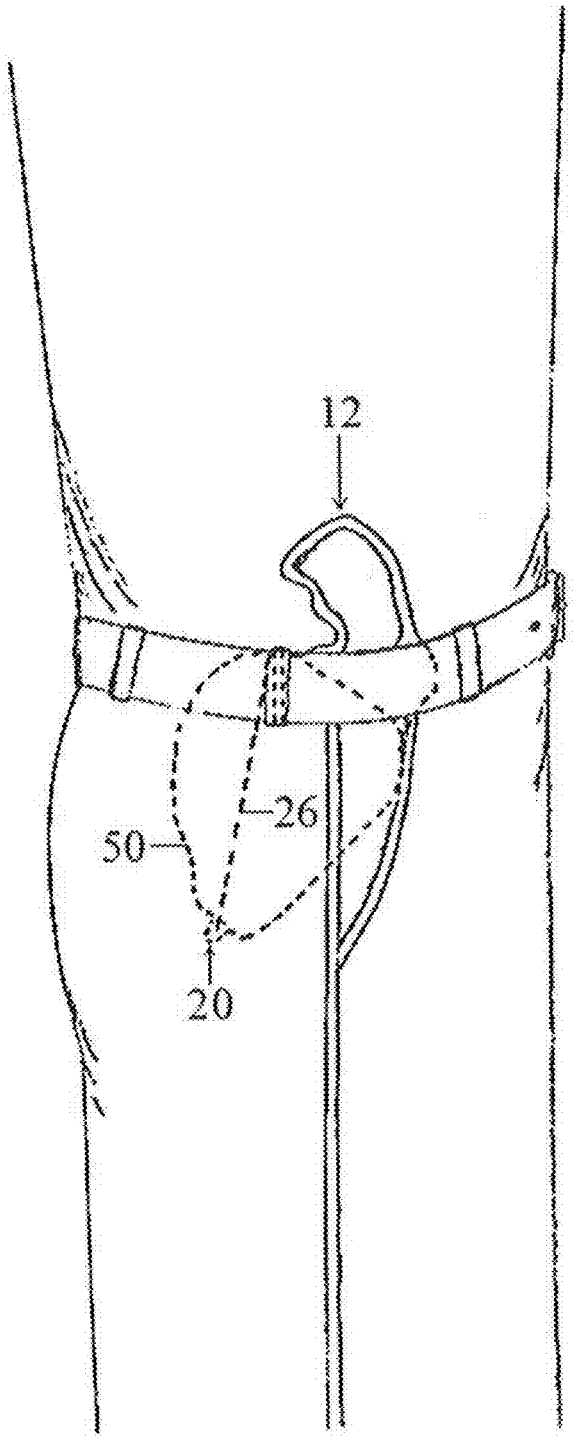
FIG. 10 illustrates a side view of a firearm in a holster positioned on a user wherein the firearm is positioned on the strong side, forward-cant.
Figure 11:
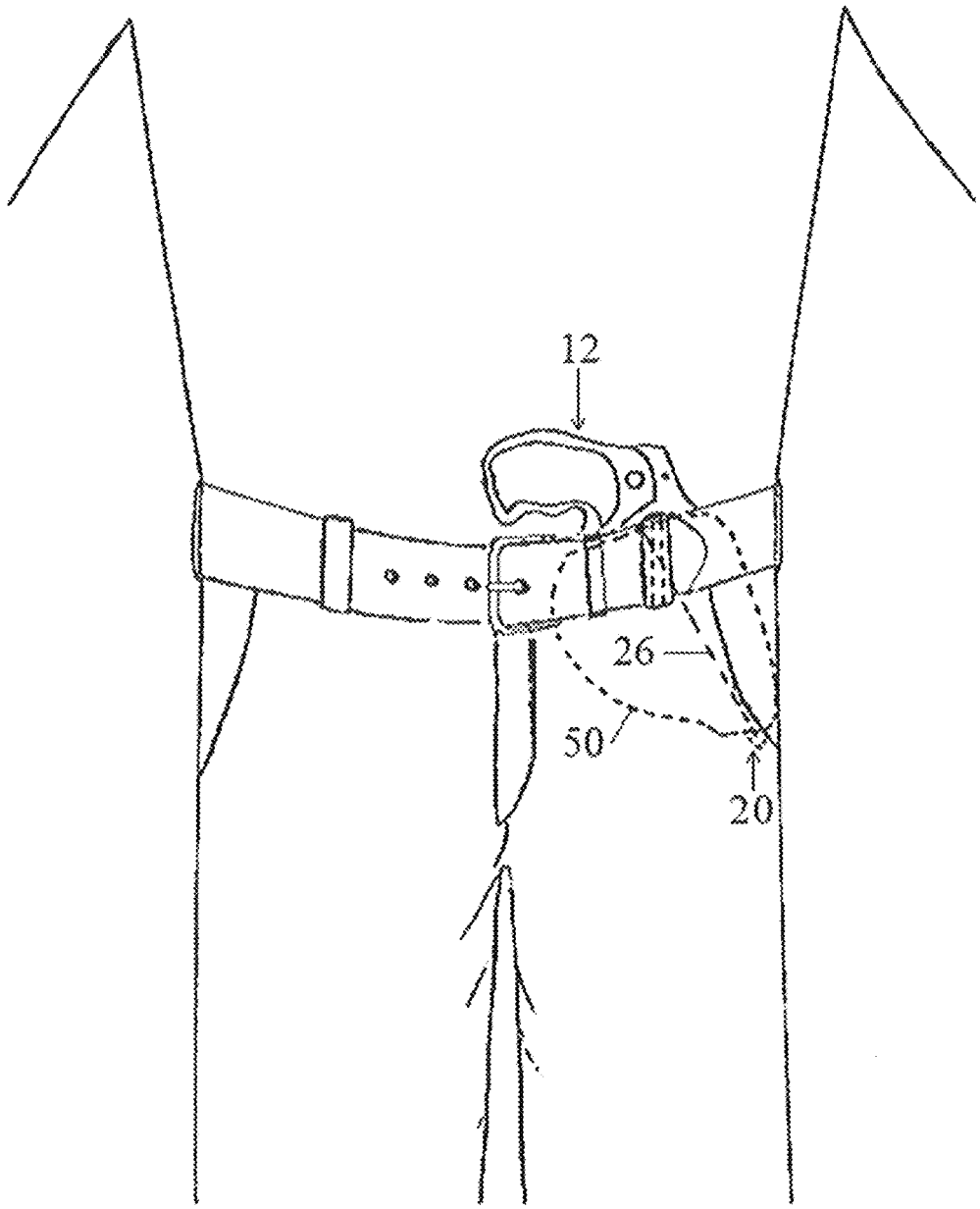
FIG. 11 illustrates a side view of a firearm in a holster positioned on a user wherein the firearm is positioned the weak side, rear-cant to facilitate a cross draw.

The flexibility of the anchor system 20 in relation to the strap 26 allows the holster to accommodate various make and model firearms and allows the user to employ a preferred style of carry, for example one or more of a strong-side/forward-cant, see FIG. 10 strong-side/straight-drop, see FIG. 9 or weak-side/cross-draw, see FIG. 11.

Figure 15:
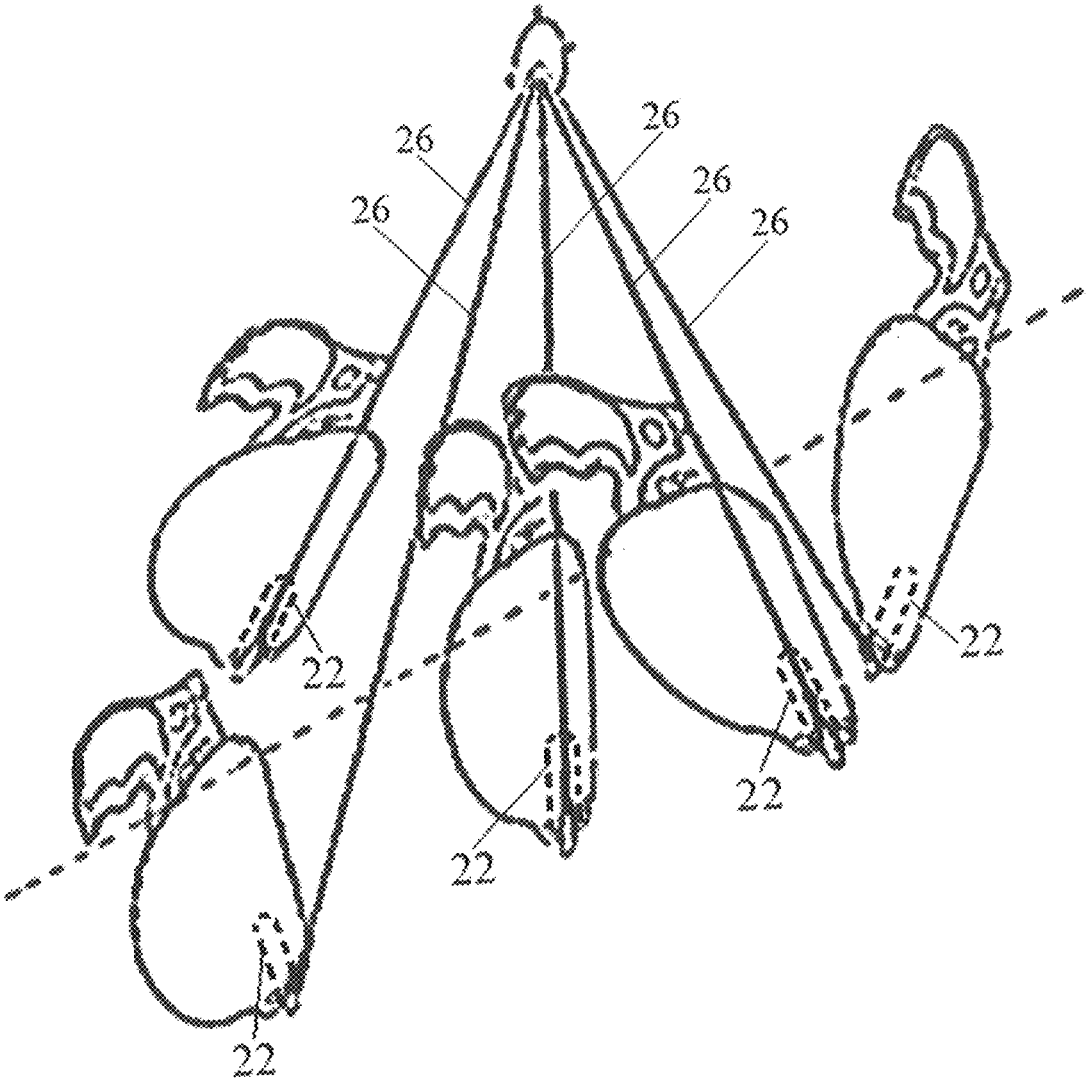
FIG. 15 illustrates a side view of various embodiments of positioning available through use of the holster of the present invention.

FIG. 15 further illustrates the flexibility and dynamic nature of the holster 10 of the present invention and illustrates various X, Y and Z directional positioning of the barrel support 22 with respect to the pivot point.

The anchor system 20 is designed to eliminate the possibility of a firearm 12 sliding through the waistband by securing the firearm barrel 13. The anchor is formed having a relatively small size in order to not hinder concealment. The barrel support 22 is designed to be dimensionally smaller than the barrel 13 of a firearm 12 and can vary in size depending upon the diameter of the particular barrel 13. Preferably, the barrel support is substantially cylindrical and has a diameter smaller than the diameter of the barrel of the firearm. The barrel support 22 has a curved or rounded distal end in one embodiment such as shown in FIG. 2. Therefore, it is possible to ensure that the firearm 12 can be easily separated from the barrel support 22 of the anchor system 20 and prevent the possibility of the anchor system barrel support 22 from binding to or otherwise becoming entangled with the firearm during deployment. It is believed that by attaching the anchor system 20 to the lowest possible point on the firearm in the carrying position, i.e. at the muzzle, is the best way to provide balance, support, positioning, and securement of the firearm within the confines of the user's waistband.

The anchor system 20 can be made from a number of different materials, both natural and synthetic. For example, suitable materials include but are not limited to, wood, metals, and polymers. The barrel support should be formed from a material that is resistant to moisture and perspiration. The barrel support should also have a low friction surface and coefficient of expansion in order to aid in removing the same from the barrel of the firearm when necessary. From this standpoint, various polymers can be utilized to form the barrel support or anchor system, for example, but not limited to polymers both thermoset and thermoplastic, with examples including but not limited to ABS resins, polyolefins, EVA, polyacrylates, polyamides, polycarbonates, polyesters, polystyrene, polyurethane and halogenated resins such as polyvinyl chloride and polytetrafluoroethylene (PTFE), and the like. When polymers are utilized, the composition thereof can include corrosion inhibitors. In one embodiment, the barrel support is formed from a polytetrafluoroethylene material, for example Teflon® which is resistant to moisture and has low surface friction.

The diameter or size of the barrel support can vary depending upon the caliber of firearm to be carried in the holster. For example, for .22 through .32 caliber firearms, the barrel support preferably has a diameter of about 3/16 inch (about 4.8 mm) for .380, .38, .357, 9 mm, 10 mm, and .40 caliber firearms about a 5/16 inch (about 7.9 mm) diameter barrel support can be utilized. For firearms of .45 caliber and up, a 3/8 inch (about 9.5 mm) diameter barrel support can be utilized, for example.

While it is illustrated that the barrel support 22 and base 24 are integrally formed, it is to be understood that the base 24 and barrel support 22 can be formed separately and thereafter connected to one another. Additionally, the base 24 in some embodiments can have a larger diameter than the barrel support thereby allowing the end of the barrel of the firearm to rest upon the base.

Figure 3:
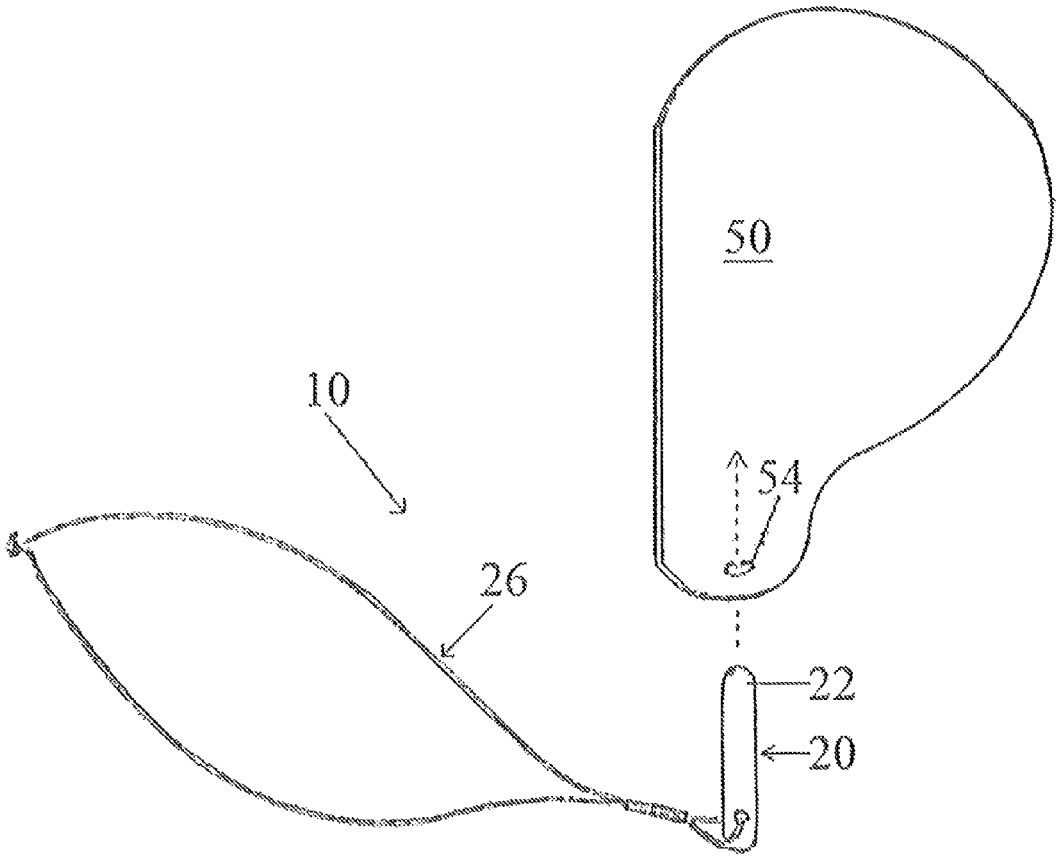
FIG. 3 is a plan view of one embodiment of a shroud of the present invention further illustrating the manner in which the shroud is attachable to the anchor system.
Figure 4:
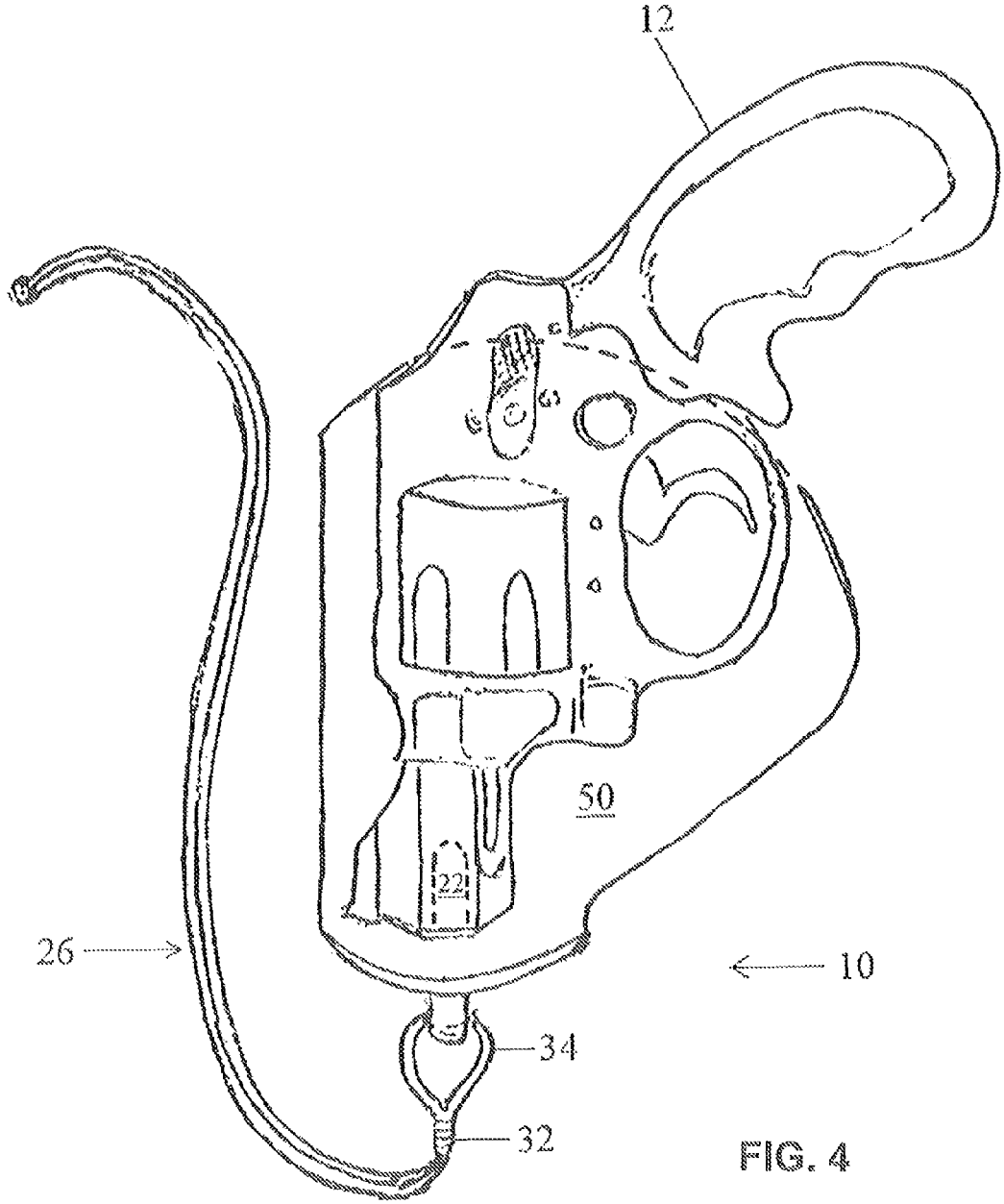
FIG. 4 is a side view of a further embodiment of a holster of the present invention, wherein the holster is shown including one embodiment of a shroud operatively connected to the anchor system, wherein the anchor is inserted into the barrel of a hand gun with the trigger shroud attached.
Figure 7:
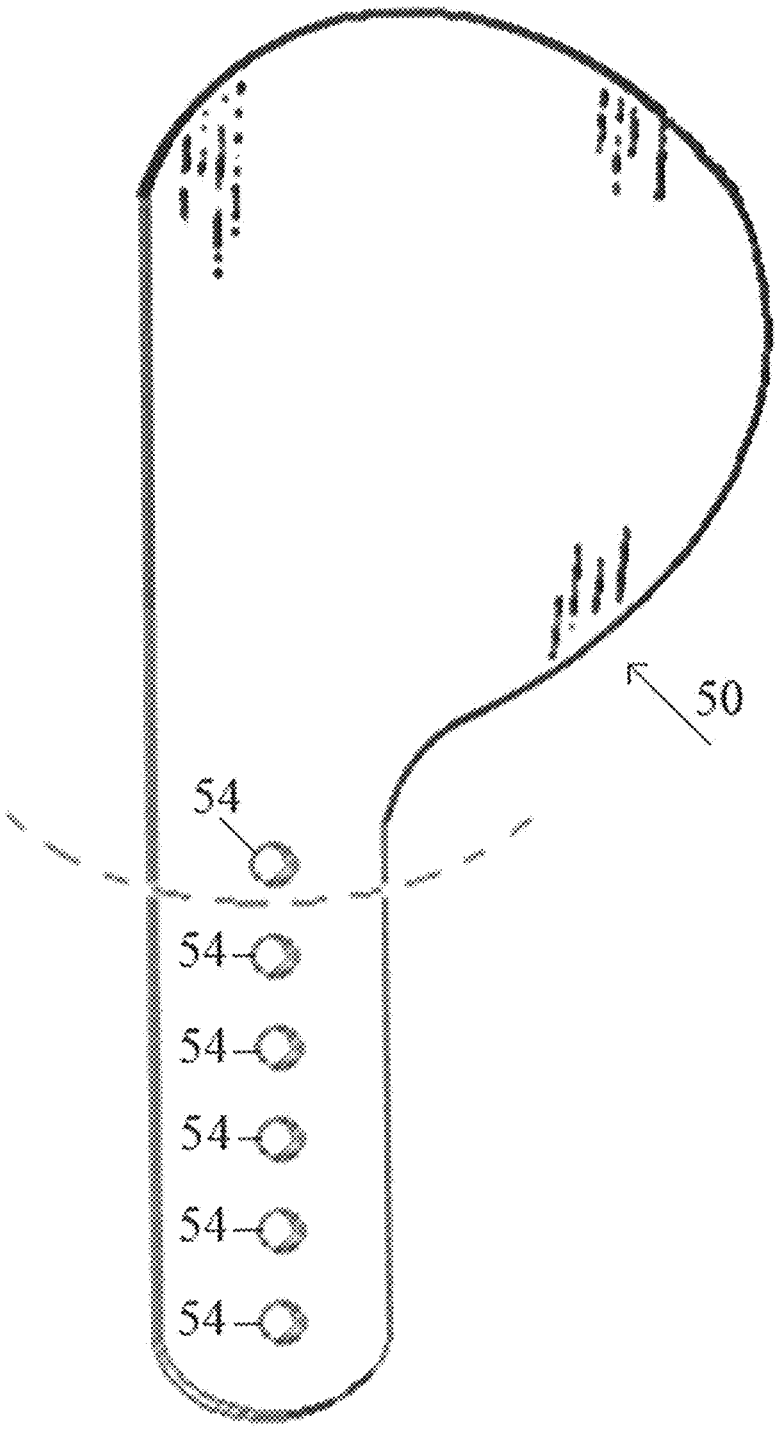
FIG. 7 is a front view of a further embodiment of a shroud of the present invention including multiple strap or anchor line apertures.

As described hereinabove, in various embodiments the holster 10 includes a shroud 50 adapted to serve as a trigger guard for the firearm. The shroud 50 includes at least one aperture 54, such as illustrated in FIG. 3. In another embodiment, the shroud 50 can include a plurality of apertures, see FIG. 7 for example. The apertures 54 allow connection of the shroud 50 to one or more of the anchor system 20 and strap 26. In one embodiment as illustrated in FIGS. 3 and 8, the shroud 50 is operatively connected to the anchor system 20 generally by inserting the free or distal end of a barrel support 22 through aperture 54. The shroud can be permanently connected to one or more of the anchor system or strap if desired. As illustrated in FIG. 8, the shroud is additionally secured in place by the weight of the firearm 12 as the barrel 14 end rests on the lower portion of the shroud.

When a plurality of apertures are utilized on the shroud, varying sizes and models of firearms can be accommodated. Once a user identifies an aperture that corresponds to the size of a firearm to be carried, the shroud may be trimmed by cutting, trimming or the like to remove any extra material and unused outlying apertures, See for example the dashed line in FIG. 7.

Various materials can be utilized to form shroud 50. Examples of suitable materials include both natural and synthetic materials. For example, leather polyurethane and/or Cordura® or other synthetic fabric can be utilized in one embodiment. The material chosen should be stiff enough to maintain its shape and not collapse but, it has to be pliable and thin enough to conform to the contours of the gun so as not to hinder concealment.

Figure 5:
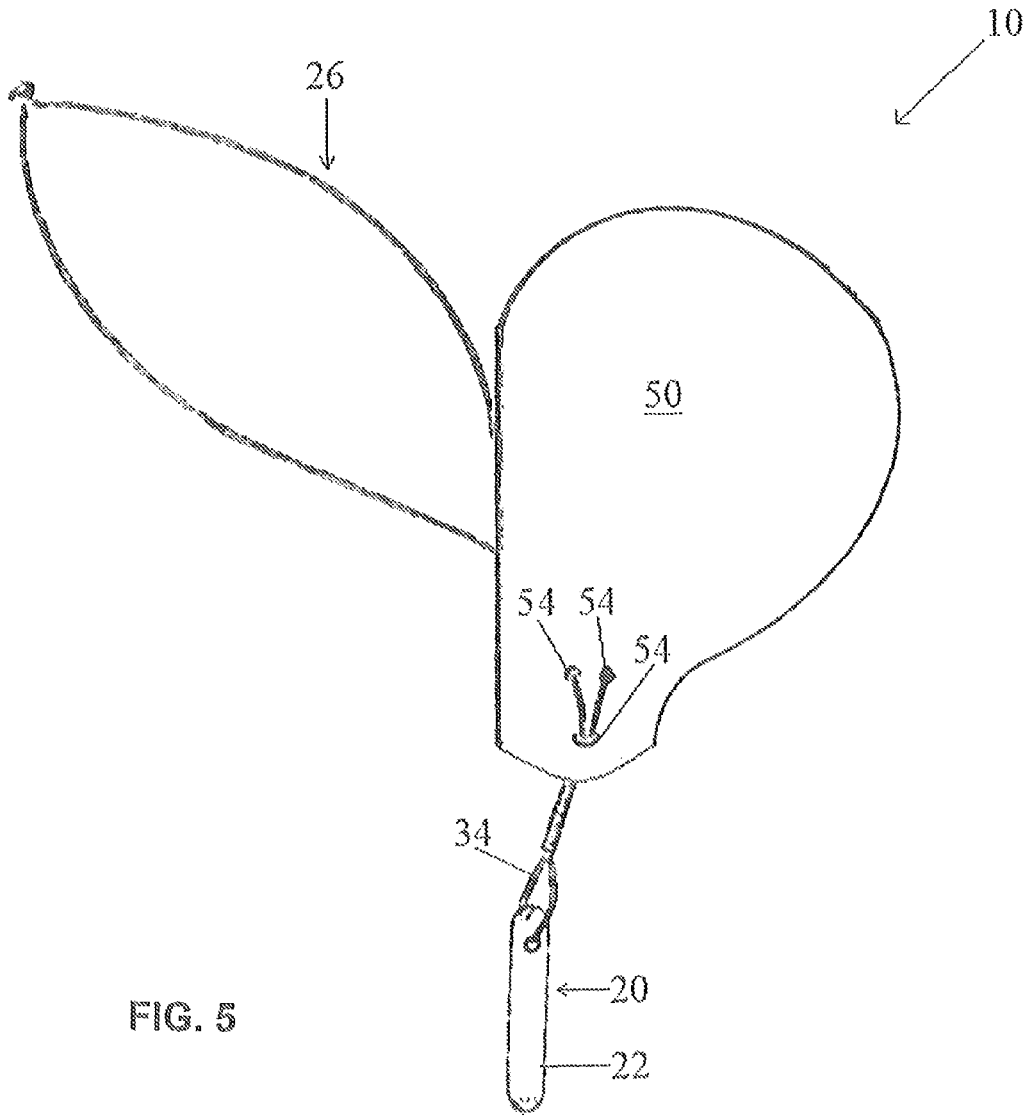
FIG. 5 is a side view of a further embodiment of a holster of the present invention wherein a shroud is permanently attached to the strap.

FIG. 5 illustrates a further embodiment of a holster 10 of the present invention. In the configuration illustrated, the shroud 50 is permanently attached to the strap 26 with a portion of the strap extending through apertures 54. The anchor system 20 including barrel support 22 is connected to a distal end of strap 26 through anchor loop 34.

Figure 6:
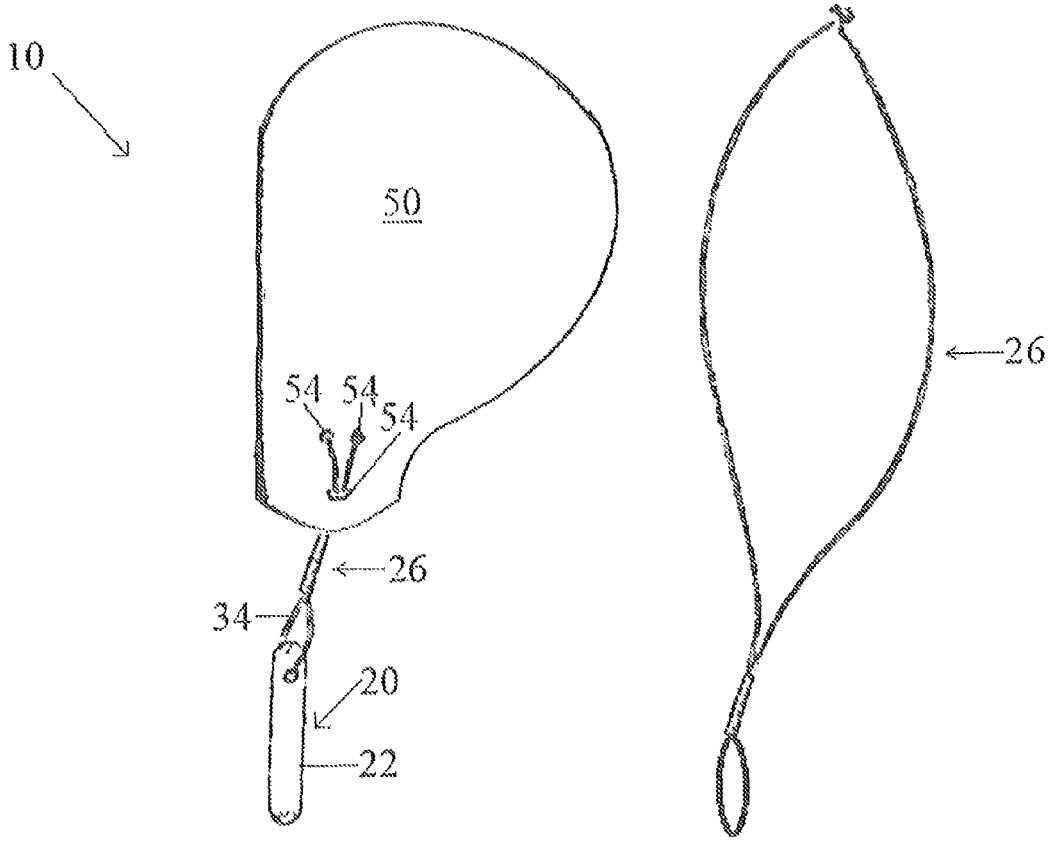
FIG. 6 is a side view of a further embodiment of a holster of the present invention wherein a shroud is permanently connected to the anchor system and the strap is shown separate from, but attachable to the shroud and the anchor system combination.

FIG. 6 illustrates an additional embodiment wherein the shroud 50 is permanently connected to one section of strap 26. An additional strap is provided which is separate from the holster portion including anchor system 20 and shroud 50 in order to make attaching or detaching the holster easier to facilitate. Once the individual strap 26 is attached to a user, the anchor is threaded through a loop in the strap at a point where the bottom of the shroud can rest on the bottom loop of the individual strap.

Figure 14:
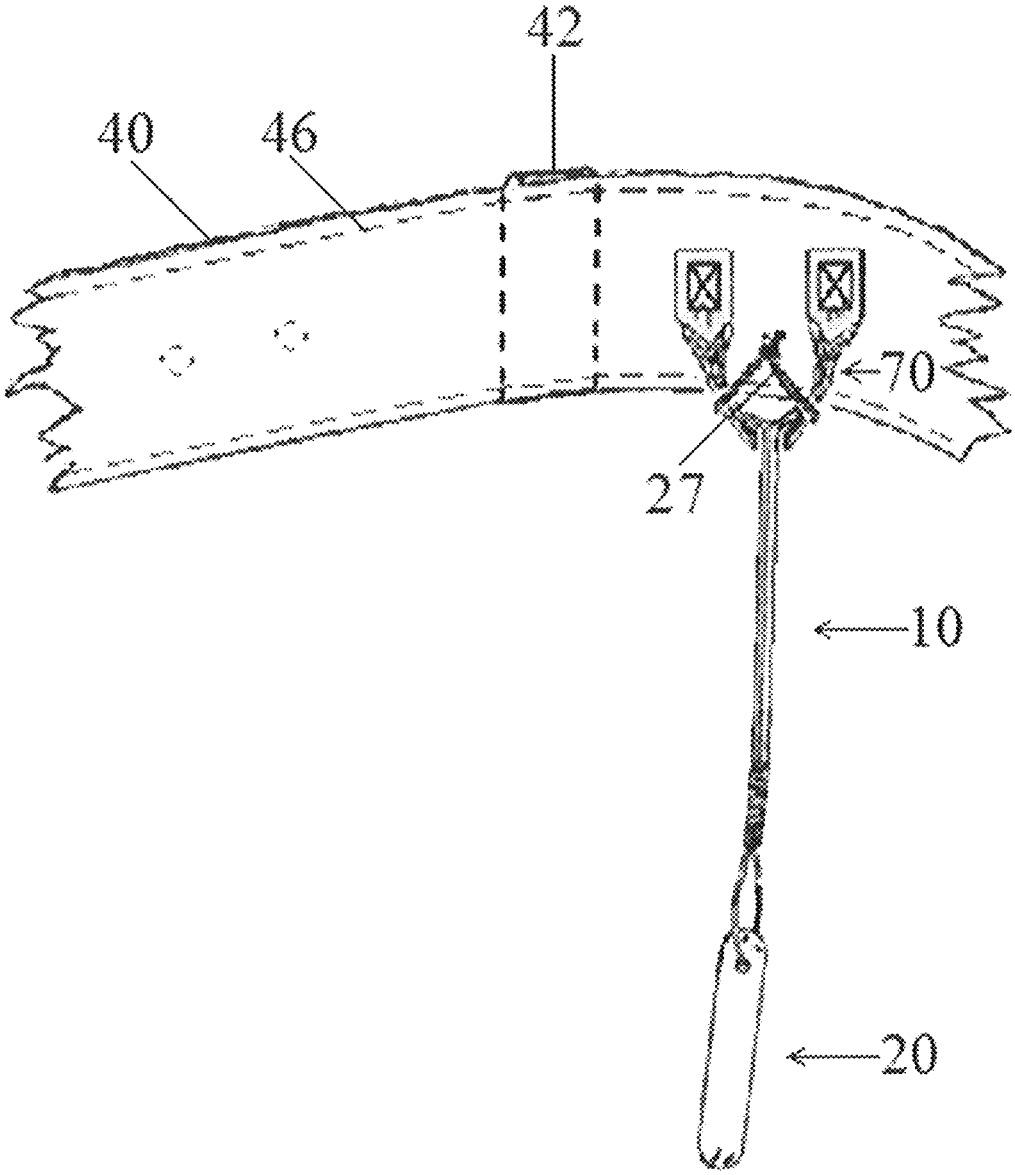
FIG. 14 illustrates a side view of the attachment of one embodiment of a holster of the present invention to an auxiliary gear loop connected to an article of clothing preferably by sewing in place to facilitate exact placement and positioning of a firearm which can be utilized when a belt loop is located in an awkward or inconvenient location.

The holster of the present invention can be utilized in various ways. The holster or firearm anchor is preferably utilized in conjunction with a pair of bottoms such as trousers or shorts. The bottoms are preferably equipped with a belt loop, a button hole or an auxiliary gear loop or a belt. It is also possible to utilize the device in conjunction with bottoms that are equipped with an elastic waistband and drawstring provided that the bottoms have a button hole or auxiliary gear loop 70 installed thereon, see FIG. 14. In a first step, an attachment point is located, such as belt, button hole, or auxiliary gear loop that is close to the general proximity of the area where it is desired to secure the firearm. The anchor system 20 is preferably grasped by the user such that the strap is oriented towards the ground. The anchor system is threaded through or behind the location at which the holster will be tethered and the anchor system is led through a looped portion of the strap such that the holster is now secured to the desired attachment location. The connection loop can be hid underneath a portion of the bottom such as the belt loop to provide concealment. The holster can be tightened and secured to the point of attachment by ensuring a snug loop by pulling on the anchor system such as up and away from the waistline.

To secure the firearm that is intended to be concealed, the barrel support is inserted into the muzzle end of the firearm barrel. As the weapon is tucked into the waistband of the user, it is preferred that the strap is maintained substantially taut to prevent the barrel support from sliding out of the barrel. The firearm is tucked until such a point where the strap becomes taut and preferably the muzzle of the firearm comes to rest on the looped portion of the strap that passes through the bottom portion of the anchor system. Once the firearm is securely resting on the anchor loop of the strap, the user can position or tilt the firearm to satisfy the style of carry and concealment preferences. The weight of the firearm effectively locks the strap in place and prevents slippage thereof. Placing a top such as a shirt over the firearm completes the concealment process, such as shown in FIG. 1.

In order to secure a firearm that is intended to be worn underneath a shirt that is tucked in, over and on top of the firearm, making use of a holster with a trigger shroud is highly recommended. After the above noted steps are completed, the trigger shroud is held in the user's hand so that the barrel support can be inserted through a desired aperture of the shroud until the shroud comes in contact with a portion of the strap such as the anchor loop. Thereafter, the barrel support is inserted into the muzzle end of the firearm until the muzzle of the weapon comes to rest on the trigger shroud. As the firearm is tucked into the waistband, the shroud is maintained adjacent the firearm in order to ensure that a portion of the shroud covers or lies adjacent to the trigger area. Again, the firearm is tucked into the user's waistband until such a point where the strap becomes taut and the muzzle of the firearm comes to rest in an area of the trigger shroud that has been passed through the barrel support. Once the firearm securely rests on the holster, it can be positioned or tilted as desired by the user to fit his or style of carry and concealment preferences. When the shroud is utilized a portion of the user's top can be tucked between the trigger shroud and the strap.

Should the need to utilize a firearm arise, it can be quickly deployed by lifting or un-tucking and lifting a portion of the top that covers the firearm with the weak hand. The strong hand is free to maintain control of the firearm and initiate the drawing process. Once the process of drawing the firearm has commenced any upward movement of a sufficient distance will disengage the barrel support from the firearm. This allows for an extremely smooth draw and ensures that the firearm is free from obstructions and combat ready the moment the muzzle of the firearm clears the waistband of the user.

While in accordance with the patent statutes, the best mode and preferred embodiment have been set forth, the scope of the invention is not limited thereto, but rather by the scope of the attached claims.

What is claimed is:

1. A method for using a holster for a firearm, comprising the steps of:

obtaining a holster comprising a flexible anchor line having a first end portion adapted to be connected to an article of clothing of a user and a second end portion;

a substantially cylindrical, single piece anchor system operatively and pivotally connected directly to the second end portion of the anchor line via an aperture in the anchor system, the anchor system having a barrel support extending from a base of the anchor system and adapted to fit inside a portion of a bore of a barrel of the firearm, wherein the pivotal connection allows the barrel support to be moved in each of an X direction, a Y direction and a Z direction of a three-dimensional (X, Y, Z) Cartesian coordinate system in relation to the anchor line, with the Z direction being a vertical axis;

connecting the first end portion of the flexible anchor line to an article of clothing of the user;

inserting the barrel support of the anchor system into the bore of the barrel of the firearm; and tucking the firearm into a waistband of the user, barrel first, until the anchor line becomes taut with weight of the firearm resting on the anchor line.

2. The method for using a holster for a firearm according to claim 1, wherein the base includes the aperture, and wherein a portion of the anchor line extends through the aperture.

3. The method for using a holster for a firearm according to claim 2, wherein the base aperture is considered a pivot point having (0,0,0) X, Y, Z coordinates, wherein in relation to the pivot point an end of the barrel support can be positioned in a positive Z position and one or more of a positive X, positive Y position; positive X, negative Y position; negative X, positive Y position; and negative X, negative Y position when the firearm is positioned on the barrel support.

4. The method for using a holster for a firearm according to claim 2, wherein the anchor line is a single piece of line having two ends that are tied together, wherein a serving material is wrapped around and locked to two portions of the anchor line such that the anchor line is separated into a first loop and a second loop, wherein the second loop extends through the aperture.

5. The method for using a holster for a firearm according to claim 4, wherein the barrel support has a rounded or tapered end that fits inside the bore of the barrel of the firearm.

6. The method for using a holster for a firearm according to claim 1, wherein the anchor line comprises polymer fibers, and wherein the barrel support comprises a polymer.

7. The method for using a holster for a firearm according to claim 1, wherein the holster further includes a shroud, wherein the shroud includes an aperture, wherein a portion of the barrel support extends through the shroud aperture.

8. The method for using a holster for a firearm according to claim 7, wherein the shroud includes a plurality of apertures.

9. A method for using a holster for a firearm, comprising the steps of:

obtaining a holster comprising a contour conformable strap having a length and wherein the strap includes a permanent first loop and a permanent second loop; and an anchor system operatively and directly connected to the strap wherein the second loop extends through an aperture in a base of the anchor system such that a barrel support of the anchor system can be positioned at any angle with respect to the strap, the barrel support having a substantially cylindrical segment adapted to be inserted into a bore of a barrel of the firearm;

connecting the first permanent loop to an article of clothing of a user;

inserting the substantially cylindrical segment of the barrel support into the bore; and tucking the firearm into a waistband of the user, barrel first, until the strap becomes taut with weight of the firearm resting on the anchor system.

10. The method for using a holster for a firearm according to claim 9, wherein the strap is length adjustable.

11. The method for using a holster for a firearm according to claim 9, wherein the base aperture is considered a pivot point having (0,0,0) X, Y, Z coordinates, wherein in relation to the pivot point an end of the barrel support can be positioned in a positive Z position and one or more of a positive X, positive Y position; positive X, negative Y position; negative X, positive Y position; and negative X, negative Y position when the firearm is positioned on the barrel support.

12. The method for using a holster for a firearm according to claim 9, wherein the anchor system comprises a base connected to the barrel support, and wherein the strap is connected between the base and a fastener.

13. A holster for a firearm, comprising:

a contour conformable strap having a length;

a substantially cylindrical, single piece anchor system operatively and directly connected to the strap such that a barrel support of the anchor system can be positioned at an angle with respect to the strap, the barrel support having a segment adapted to be inserted into a bore of a barrel of the firearm; and a trigger shroud comprising a piece of material having an aperture through which one or more of a portion of the strap and anchor system extend, wherein the shroud is operatively connected to the anchor system through the barrel support which extends fully or partially through the shroud aperture, and wherein a portion of the shroud extends from the aperture and is adapted to cover or lie adjacent to a trigger of the firearm.

14. A holster according to claim 13, wherein the anchor system includes a base that includes an aperture, and wherein a portion of the strap extends through the aperture.

15. The holster according to claim 14, wherein the base aperture is considered a pivot point having (0,0,0) X, Y, Z coordinates, wherein in relation to the pivot point an end of the barrel support can be positioned in a positive Z position and one or more of a positive X, positive Y position; positive X, negative Y position; negative X, positive Y position; and negative X, negative Y position when the firearm is positioned on the barrel support.

16. The holster according to claim 13, wherein the barrel support has a rounded or tapered end adapted to fit inside the bore of the barrel of the firearm.

17. The holster according to claim 13, wherein the strap comprises polymer fibers, and wherein the barrel support comprises a polymer.

18. The holster according to claim 12, wherein the holster further includes a shroud, wherein the shroud includes an aperture, wherein a portion of the barrel support extends through the shroud aperture.

* * * * *